United States Patent [19]

Eisenmann et al.

[11] 4,177,025

[45] Dec. 4, 1979

[54] HIGH-PRESSURE ROTARY FLUID-DISPLACING MACHINE

[75] Inventors: Siegfried Eisenmann; Hermann Härle, both of Aulendorf, Fed. Rep. of Germany

[73] Assignee: Fürstlich Hohenzollernsche Hüttenverwaltung Laucherthal, Hohenzollern, Fed. Rep. of Germany

[21] Appl. No.: 812,392

[22] Filed: Jul. 1, 1977

[30] Foreign Application Priority Data

Jul. 6, 1976 [DE] Fed. Rep. of Germany ..... 2630222

[51] Int. Cl.[2] ..... F04C 15/00

[52] U.S. Cl. ..... 418/133; 418/170

[58] Field of Search ..... 418/133, 169, 170, 171

[56] References Cited

U.S. PATENT DOCUMENTS

| | | | |
|---|---|---|---|
| 3,024,736 | 3/1962 | Erdmann | 418/133 X |
| 3,479,962 | 11/1969 | Pettibone | 418/133 |
| 3,907,470 | 9/1975 | Harle et al. | 418/170 |

FOREIGN PATENT DOCUMENTS

| | | | |
|---|---|---|---|
| 1280056 | 10/1968 | Fed. Rep. of Germany | 418/133 |

*Primary Examiner*—William L. Freeh
*Assistant Examiner*—Leonard E. Smith
*Attorney, Agent, or Firm*—Heinrich W. Herzfeld; Gilbert L. Wells

[57] ABSTRACT

A high-pressure rotary fluid-displacing machine is described which is suitable for use as a motor or pump. It comprises a housing, an internally toothed annular gear, an externally toothed pinion arranged eccentrically within said annular gear and intermeshing therewith, an engagement-free crescent-shaped gap being left between the addendum circles of the pinion and of the annular gear, respectively, on the side thereof opposite the contact point of the pitch circle of the pinion with the pitch circle of the annular gear, a shaft bearing the pinion and being adapted for transmitting torque, and a gap-filling member in the gap having an inner and an outer curved surface, the inner surface being sealingly contacted by the addendum surfaces of the teeth of the pinion, and the outer surface being sealingly contacted by the addendum surfaces of the teeth of the annular gear. The housing is composed of at least two parts and has a first channel in said housing for conveying fluid medium under high-pressure therethrough and a second channel in said housing for conveying a fluid medium under lower pressure therethrough. The machine further comprises at least a first lateral plate member being adapted for closing off laterally a work space intermediate the teeth of the pinion and the teeth of the annular gear and disposed in axial direction on one side of the said pinion and annular gear, the central region of the plate member being movable wth a slight clearance relative to the pinion, and the plate member having an external rim portion clamped in between two parts of the housing, and a collar on each plate member present and projecting from the face of the latter away from the pinion and annular gear and adapted for bearing the pinion shaft therein, the housing having an internal chamber into which the collar protrudes, the internal chamber being in free communication with the first channel in the housing, whereby the plate member can be subjected to high-pressure exerted by the high-pressure fluid medium.

25 Claims, 5 Drawing Figures

Fig.1
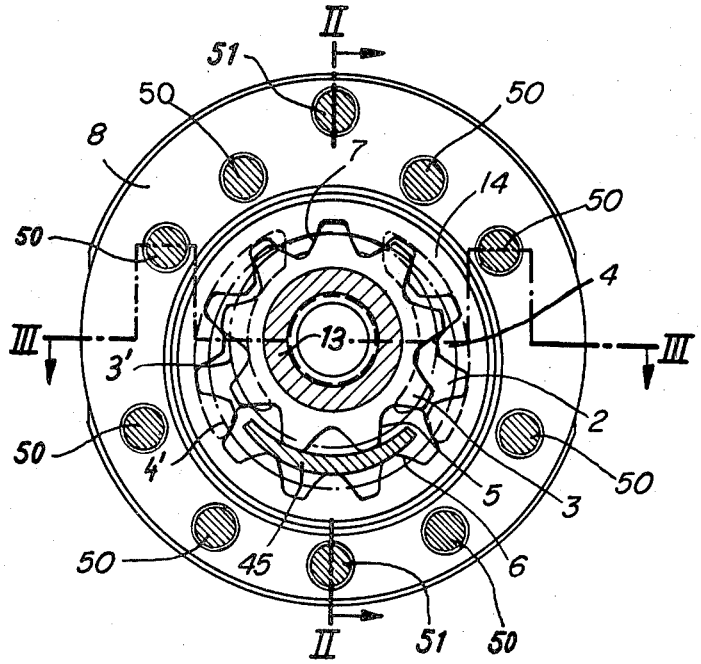
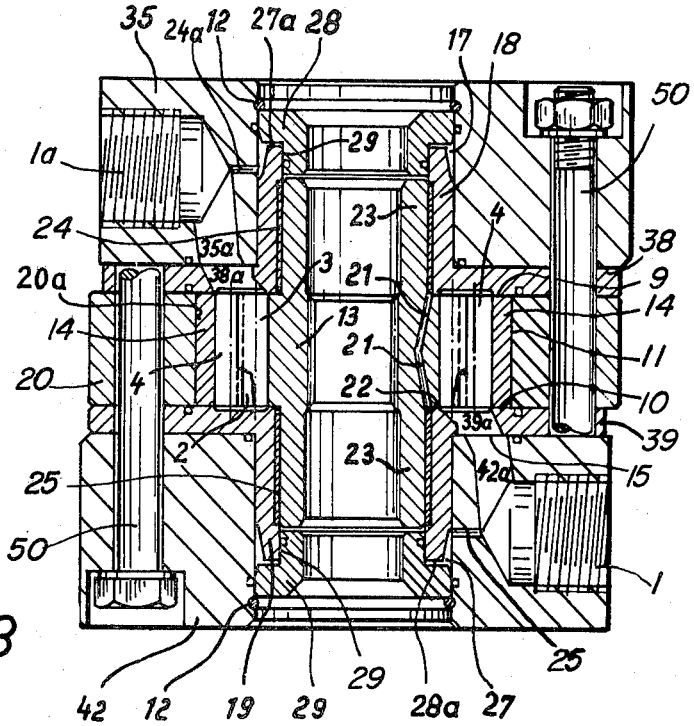
Fig.3

HIGH-PRESSURE ROTARY FLUID-DISPLACING MACHINE

BACKGROUND OF THE INVENTION

This invention relates to a high-pressure rotary fluid-displacing machine suitable for use as a motor or pump, which machine comprises a housing, an internally toothed annular gear, an externally toothed pinion arranged eccentrically within said annular gear and intermeshing therewith, an engagement-free crescent-shaped gap being left between the addendum circles of the pinion and of the annular gear, respectively, on the side thereof opposite the contact point of the pitch circle of the pinion with the pitch circle of the annular gear, a shaft bearing the pinion and being adapted for transmitting torque, and a gap-filling member in the gap having an inner and an outer curved surface, the inner surface being sealingly contacted by the addendum surfaces of the teeth of the pinion, and the outer surface being sealingly contacted by the addendum surfaces of the teeth of the annular gear.

More in particular, the invention relates to an internal gear pump or an internal gear motor with an inwardly-toothed, annular gear rotatable with constant axial clearance and radial clearance, which axially limit the working spaces between two plate members, and with an outwardly-toothed pinion mounted on a shaft for rotation therewith and meshing with the annular gear, a crescent-shaped gap-filling piece with broken-off points being provided on the side opposite to the point where the engagement of the teeth is deepest, and along which gap-filling piece the addendum surfaces of the teeth of the gears slide in a leak-proof manner.

Internal rotary machines are known which are provided with trochoidal internal gear and can operate both as pumps and as motors, and in which a sealing between low pressure and high pressure media in the region between the toothed gear rims facing each other is effected solely by the mutual cooperation of the tooth profiles of the two gears. A machine of this type is described in U.S. Pat. No. 3,619,093. In order to fulfill the well-known requirement for little leakage of the working fluid and, at the same time, high working pressures, the known machines must be built with extraordinarily tight manufacturing tolerances for the toothing which, in most cases, entails unacceptably high manufacturing costs especially in the case of internal toothing. At first sight, the construction of such machines appears to be comparatively simple, but it has been found that the volumetric delivery rate, and hence the torque increase or decrease, varies strongly with the angle of rotation so that a pulsating fluid flow or, in the case of a motor, a varying torque is the undesirable result.

In U.S. Pat. No. 3,491,698 and, particularly, 3,907,470, there are described machines with involute or trochoidal internal toothing of the type mentioned initially which, to a large extent, overcome these drawbacks by the provision of a crescent-shaped gap-filled piece, in the non-engagement region of the toothing. The main object in the conception of this machine is, however, primarily to attain a high volumetric efficiency and a high degree of counteracting or equalizing wear, and not to obtain a strict reversibility of the direction of rotation and a high starting torque on switching on the machine, wherefor these known machines fail to possess in full the last-mentioned two properties which are, however, indispensable for hydraulic motors.

OBJECTS AND SUMMARY OF THE INVENTION

The problem which the invention sets out to solve is to achieve, in a machine of the initially outlined type, an axial clearance or play in the proximity of the shaft, smaller in places of high pressure and larger in places of low pressure and freedom from hindrance of axial thermal expansion. Moreover, it is an object of the invention to provide a machine of the initially mentioned type which combines the features of very low pulsation and high volumetric efficiency at high pressures with a strict reversibility of the direction of rotation and minimal self-friction on starting the machine under high torque or pressure. A solution of this problem and achievement of these objets is known to require a hydrostatically, axially as well as radially, floating, internal gear with adequate clearance in the entire pressure region, very tight running clearance between the addendum circles of the teeth of the gap-filling member, and the avoidance of axial and radial gaps becoming enlarged under the influence of high hydrostatic forces.

It must be further ensured that the bearing of the pinion shaft has only a very low coefficient of friction and that even, when the machine is stopped, the bearing has an adequate supply of lubricating oil. Finally, the construction of the machine must comprise two groups of components, a first group of abnormally rigid components capable of absorbing high bolting forces by virtue of the high module of elasticity of its material, but on which no excessive requirements for accuracy are placed, and a second group of components which have good sliding properties and at the same time very great accuracy of dimensions, but combined with low rigidity to allow for formation of certain axial and radial gaps.

According to the invention these objects are achieved in a high-pressure rotary fluid-displacing machine of the initially described type, which is improved in accordance with the invention by a combination of features in that the housing of the machine is composed of at least two parts and has a first channel in said housing for conveying fluid medium under high-pressure therethrough and a second channel in said housing for conveying a fluid medium under lower pressure therethrough and by at least a first lateral plate member being adapted for closing off laterally a work space intermediate the teeth of the pinion and the teeth of the annular gear and disposed in axial direction on one side of the said pinion and annular gear, the central region of the plate member being movable with a slight clearance relative to the pinion, and the plate member having an external rim portion clamped in between two parts of the housing, and a collar on each plate member present and projecting from the face of the latter away from the pinion and annular gear and adapted for bearing the pinion shaft therein, and by that the housing has an internal chamber into which the collar protrudes, the internal chamber being in free communication with the first channel in the housing, whereby the plate member can be subjected to high-pressure exerted by the high-pressure fluid medium. The plate member can have an opening therein which constitutes a part of the above-mentioned first channel.

Preferably, the machine according to the invention comprises a first and a second lateral plate member, which members limit the working spaces in axial direction between meshing teeth of the pinion and the annular gear on both sides of these two gear members, and which two plate members are clamped in between the parts of the housing and have outwardly projecting collars for bearing the pinion shaft.

The housing has another internal chamber, into which the collar on said second plate mamber protrudes, the other internal chamber being in free communication with the aforesaid second channel, whereby the low-pressure of the low-pressure fluid medium can be exerted on the second plate member. At least the central portions of the first and second plate members are preferably slightly axially deformable.

The collars of the two plate members can move axially in the housing to a small extent together with those parts of the two plate members which form the axial seal of the working spaces in the region of the pinion.

The axial clearance of the inwardly-toothed annular gear is determined by the thickness and/or width of an intermediate annular housing part surrounding the annular gear, together with the elastic static distortion of the bolting surfaces, i.e. the surfaces pressed together by screwing down bolt-and-nut means serving to hold the entire assembly together.

The intermeshing gearing of the annular gear and pinion can be a trochoidal gearing and is preferably a hypocycloidal gearing.

The intermediate annular housing part has a central bore, in which the annular gear is lodged, and further comprises a sliding layer covering the inner surface of the bore, which sliding layer is preferably of tin-copper bronze alloy.

The axial play of the toothed pinion is limited by the thickness and/or width of the intermediate annular housing part and the elastic deformability of the region of the plate members adjacent the pinion, which deformation results from the forces of the axial working surfaces and compensation surfaces between the parts of the machine explained hereinafter, i.e., from the sum of all forces, in axial direction, generated in the working spaces and compensating fields present therein.

The collars have each a frontal end face, and the housing can further comprise external housing parts disposed axially spaced from the frontal end faces of the collars, and the housing can further comprise sealing members between the external housing parts and the frontal end faces of the collars, which sealing members and external housing parts delimit the internal chambers into which the collars protrude.

The sealing members can serve as lids for the housing and can be sealingly connectable to the latter.

Furthermore, the housing can comprise guard rings each of which secures a sealing member against axial displacement relative to the external housing part adjacent thereto.

The first and second plate members can be fixed in determined positions relative to one another, preferably by axially extending bold-and-nut means for holding the parts of the casing together, and the two external housing parts can be centered with play solely about the respective collars adjacent to them, and are then secured against rotation by the aforesaid bolt-and-nut means.

Thereby, the first and second plate members can clamp the intermediate annular housing part firmly in position therebetween and thereby determine exactly the spacing between the axes of the pinion and of the annular gear from one another, as well as the positioning of the pinion and annular gear relative to the gap-filling member, while the external housing parts are disposed with play axially of the frontal end faces of the collars on the first and second plate members.

The shaft of the pinion can be hydrodynamically supported in said collars, in which case the housing further comprises means for automatically feeding lubricating oil to the interstices between the pinion shaft and the collars depending on the working pressure in the working spaces.

Or the shaft of the pinion can be hydrostatically supported in the collar, in which case the external housing members have central bores registering with one another for lodging the shaft of the pinion therein; these central bores have annular grooves in their walls serving as hydrostatic pressure pockets subjected to the prevailing hydrostatic working pressure, which pockets are in free communication with the working spaces and the compensating field gaps mentioned hereinbefore.

More in particular, the collars can have annular grooves and the housing can comprise sealing members between the external housing parts and the collars, which sealing members sealingly engage the annular grooves, and connecting bores can be provided in the collars for connecting the annular grooves therein with the work spaces and compensating field gaps.

In the machine according to the invention, the desired high volumetric efficiency under high working pressure of the fluid is thus achieved by providing, for the purpose of an axial balance of the forces on both sides of the plate members in the region of the working spaces, compensation fields which lie between the outward faces of the plate members and the adjacent housing parts and are subject to the prevailing working pressure, and, in addition, the collars possess axial compensation fields between their respective outer end faces and the adjacent housing parts.

The advantages of these improvements are enormous. They permit the axial clearances for the annular gear to be kept virtually constant due to the rigidity of the bolting of the parts of the housing surrounding it, so that not only an axial but also a radial floating of the internal gear is possible even at zero rotation, and the working fluid can encompass the annular gear with the same pressure on all sides in the region of the high-pressure working space, that is to say even in the gap between the annular gear and the bore of the intermediate annular housing part which surrounds the annular gear. The balance of forces thus achieved is independent of the rotational speed of the machine. At the same time, the axial clearance of the pinion can be adjusted down to permit formation of a lubricating film having only a few thousandths of a millimeter thickness, without causing any danger of axial jamming or seizing up in the region of the pinion hub. Furthermore, by providing the collars as integral parts of the respective clamped-in plate members, the bearing spacing can be kept as small as possible, thereby avoiding a noticeable bending of the pinion shaft. Moreover, a positive continuous lubrication and cooling of the two pinion shaft bearings is assured by the fact that the leakage oil which flows through the axial gap between the pinion shaft and the plate members must flow positively through the shaft bearing. In this way an increase in the oil flow, approximately proportional to the square of the pressure, is ensured through the bearing so that the increasing frictional load on the bearing with increasing working pressure can be removed. The resulting machine is completely reliable in operation and the wear on the bearings is unusually low. Finally, by means of a preferred construction of the shaft-bearing collars integral with the plate members it is possible to extend the axially inwardly operating compensation pressure field at the center of the shaft, over the entire diameter of the shaft, whereby in all cases an adequate equalization of forces becomes possible. This feature also avoids the need for supporting elements for O-rings or rubber molded parts which are necessary in most known constructions, because, in the machine according to the invention, gaps formed between the individual parts are of a width of only a few hundredths of a millimeter.

The assembly of the machine according to the invention is greatly facilitated when the following advantageous constructional features are incorporated therein:

The first and second plate members can be made equal to one another and the two axially disposed external housing parts can also be made equal to one another, and the first member of each of these pairs can be disposed relative to the second member thereof with an angular displacement of 180°. At least one of said first and second plate members can be provided with a recess or opening in which the gap-filling member is lodged with minimum play, and the gap-filling member can bear at its end faces turned towards the first and second plate members projections adapted for being inserted in the aforesaid recesses or openings of the plate members. Preferably, these projections are provided in the outwardly disposed third of the end faces of the gap-filling member.

The distribution of holes for screw-connecting the engine or pump to other apparatus is preferably symmetrical relative to bores provided in the annular housing part for the insertion therein of the bolt-and-nut means destined for holding the parts of said housing together.

In another aspect, the invention also relates to a method for assembling a machine according to the invention as described hereinbefore, wherein the parts of the machine housing are provided with a plurality of axial fastening bores for inserting the bolt-and-nut means therein, and adjusting bores are provided in the housing and extend axially through the intermediate annular housing part, the method comprising the steps of inserting assembling plugs into the adjusting bores, screwing down the nut-and-bolt means in the axial fastening bores, thereby determining the exact position of the first and second plate members relative to the annular housing part and the annular gear therein, and then withdrawing the assembling plugs from said adjusting bores. Each assembling plug can have a plurality of zones the diameters of which vary step-wise to offer different degrees of play in the adjusting bores, thereby permitting insertion into the latter of the region of the plug having minimum play in the adjusting bore.

BRIEF DESCRIPTION OF THE DRAWINGS

Hereinafter, the innovation will be explained in more detail at the hand of two preferred embodiments of the high-pressure rotary fluid-displacing machine according to the invention, illustrated in the accompanying drawings, wherein FIG. 1 shows a cross-sectional view in a plane indicated by I—I in FIGS. 2 and 3, FIG. 3 shows a further axial partially sectional view along planes indicated by III—III in FIGS. 1 and 2, the major part of which is perpendicular to the plane shown in FIG. 2, in a preferred embodiment wherein the pinion shaft is borne hydrodynamically in a sliding bearing;

DETAILED DESCRIPTION OF THE EMBODIMENTS SHOWN IN THE DRAWINGS

Figure 2:
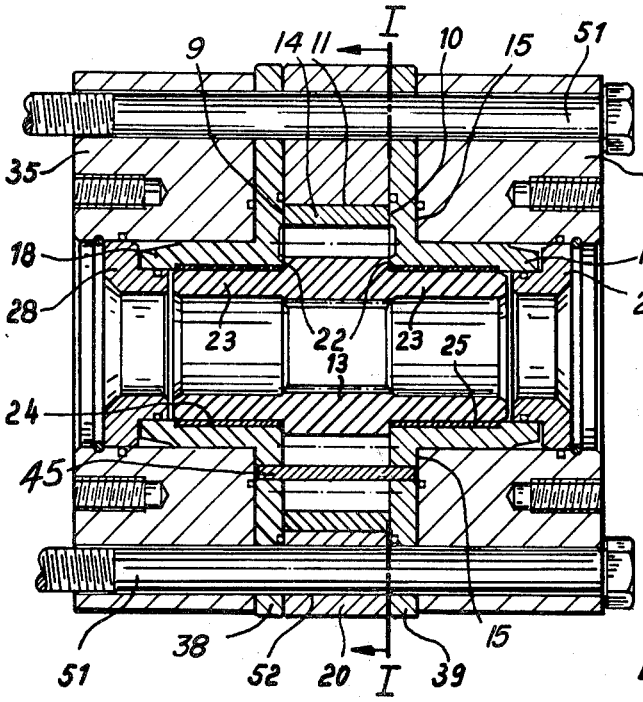
FIG. 2 shows an axial sectional view along a plane indicated by II—II in FIG. 1.

The operation of the embodiments of the machine shown in FIGS. 1 to 5 will be explained hereinafter for the case of using the machine as a hydraulic motor because, in that case, the absolute reversibility of the flow of the hydraulic pressure fluid, and of the direction of rotation is of particular importance.

With regard to the construction of the internal gear, pinion and gap-filling piece and the annular part of the housing enclosing the same, the explanations given in relation thereto in U.S. Pat. No. 3,907,470 issued on Sept. 23, 1975 are incorporated herein by reference.

The functioning of the individual components and features of the embodiments when the machine is used as a pump are self-evident and need not be explained in detail.

The hydraulic pressure fluid, preferably a hydraulic oil, enters into the machine housing through a threaded inlet bore 1 provided in the side wall of an annular external housing part 42 and flows to the high-pressure working space 2 betweeen the external teeth 3 of a pinion 13 and the internal teeth 4 of an annular gear 14 via a high-pressure channel **42*a* in housing part 42 and an opening or duct 39*a* in the adjacent plate member 39, which duct 39*a* registers with channel 42*a*, on the one hand, and with the work space 2** on the other hand.

The housing of the machine comprises a central annular housing part 20 constituting a laterally open gear box for the two gears 13 and 14 as well as the external housing part 42 at the high-pressure side of the machine and another similar external housing part 35 on the low-pressure side of the machine. The annular housing part 20 has a large-diameter central bore **20*a* in which the annular gear 14 is lodged leaving a gap 11 between its external cylindrical surface and the inner cylindrical wall of bore 20*a*. A preferably annular plate member or lateral plate 38 covers the bore 20*a* on the low-pressure side and an identically shaped plate member or lateral plate 39 covers the bore 20*a* on the high-pressure side of the annular housing part 20**.

Lateral plate 38 bears on its face away from annular housing part 20 a collar 18 axially protruding from the plate 38 into a hollow space 17 formed by an axial bore in external housing part 35, and lateral plate 39 bears on its face away from annular housing part 20 a collar 19 axially protruding from the plate 39 into a hollow space 27 formed by an axial bore in external housing part 42.

The working force of the hydraulic fluid acts on the tooth flanks 5 and 6, respectively, of pinion 13 and annular gear 14; the effective working surfaces of these flanks contribute, in the position shown, to each of the gears 13 and 14 approximately half of the effective output torque. The annular gear 14 transfers its share of torque via the tooth engagement point 7 at the contact zone of the pitch circles 3' and 4' of the teeth 3 and 4, respectively, to the pinion 13, where the two hydraulic torques come together and are transmitted via the output shaft 8 (shown only in FIG. 4), by known means, to a working machine to be driven. The hydraulic torque share of the gears 13 and 14 varies with the angle of rotation of the output shaft 8, depending on whether the mechanical tooth engagement point 7 is in the region of the tooth base or of the addendum of the teeth of the particular gear. The sum of the two torques on the output shaft should, however, vary as little as possible, and it is one of the most important advantages of the pump or motor gear in the machine according to the invention that this non-uniformity is held as small as possible. Internally toothed gears have particular advantages in this respect, and the special trochoidal gear toothing used by way of example in the embodiments of this invention shown in the drawings exhibits a theoretical coefficient of cyclic variation of only 0.9%. The hydraulic torques acting on the gears 13 and 14 are transferred to the output shaft with the least possible mechanical losses which unavoidably occur at various places in the housing. One of the largest contributors to such losses is the frictional torque of the internal-toothed annular gear at its comparatively large outer diameter. The smaller the outer diameter of the annular gear 14 and the better balanced hydraulically the radial forces generated in the working space on the annular gear 14 are, the smaller are the losses. This balance is achieved by the annular gear 14 having a defined axial clearance so that the fluid pressure can also penetrate through axial gaps 9 and 10 extending from the collar center radially outwardly between the annular housing part 20 and the axially adjacent lateral plates 38 and 39, respectively, into the outer axially extending gap 11 to produce a floating bearing for the annular gear 14. In order to ensure that this balance is achieved as completely as possible, even when sudden changes of pressure or great differences of rotational speed occur, the axial clearance of the annular gear must always remain substantially independent of the running conditions. On the other hand, a determined throttling of hydraulic pressure must occur in the gaps 9 and 10, since the outer circumference of the annular gear is larger than its internal circumference.

In practice, it has been found that axial clearances in gaps 9 and 10 in the range of from 0.5 to 1% of the width of the gear produce a good radial balance. If the axial clearances were to be reduced, however, to a lubricating film thickness of only 1 to 2 micrometers it would not be possible to achieve a satisfactory balance or to minimize the friction on the annular gear. It is, therefore, by this feature of sufficiently wide clearances (gaps 9 and 10) that the machine according to the invention differs fundamentally from prior art constructions of the initially described type.

In contrast thereto, the axial gap in the region of the pinion shaft 23 is reduced to lubricating film thickness in order to keep the losses from leakage to a minimum. The over-compensation required for this purpose is achieved when the working pressure is acting not only in gap 15 (when inlet bore 1 is under pressure) and gap 16 (when inlet bore 1A is under pressure) between the lateral plates 38 and 39 on the one hand and the adjacent external housing parts 35 and 42, but, via the radial bore 24*a*, also in the annular space 17 on the outer wall near the frontal end faces 27*a* and 28*a* of the collars 18 and 19, respectively. Sealing pieces 28 and 29 are inserted into the open ends of collars 18 and 19, respectively, and leave gaps between their inner end faces and the frontal end faces 27*a* and 28*a* of collars 18 and 19. The sealing pieces 28 and 29 are held in position by axial securing rings 12. The diameters 28*a* and 29*a* of these sealing pieces can be so varied that leakage oil at the pinion gaps 22 between the pinion 13 and the lateral plates 38 and 39 can be optimally adjusted. The connecting bores 21 in the pinion shaft 23 ensure that the leakage oil at the axial pinion gap 22 is uniformly distributed as lubricating oil on the two pinion shaft bearings 24 and 25.

In the embodiment of FIGS. 1 to 3, the pinion shaft is supported hydrodynamically. As is known, with hydrodynamic sliding bearings the friction is only low when they are run at a minimum rotational speed, and a lubricating film can thus be formed. However, with hydraulic motors, starting under full torque is often required. For this reason, special materials having particularly low static friction are used for these bearings. These can be employed and are economical up to a certain limit working pressure. They also permit starting under high load but can only be loaded up to a limited amount having regard to their working life, in particular when operated at high rotational speeds. Moreover, a continual wear during starting is unavoidable.

A substantial advantage of the machine according to the invention resides in the fact that the support of the pinion can be effected fully hydrostatically and at extremely low production cost. Such a machine is illustrated in the embodiment shown in FIG. 4. In this embodiment, only small but extremely effective changes have been made vis-a-vis the hydrodynamically supported embodiment of FIGS. 1 to 3. For the sake of clarity and completeness, the drive shaft or output shaft is here shown extending outside the machine housing and with a seal against the outside so that the machine as shown in this embodiment is fully operable.

Beginning again with a description of the motor drive, the hydraulic fluid enters the machine under pressure through the threaded bore 1. The development of the torque occurs in exactly the same manner as has been described hereinbefore for the embodiment with hydrodynamically supported pinion; the same is true as far as the radial balancing of the annular gear 14 and the axial compensation in the axial gaps on the gears 13 and 14 are concerned. The control of the bearing forces on the pinion shaft 23 is completely different and is now effected hydrostatically and is thus not dependent on the formation of a hydrodynamic lubricating film.

The high pressure fluid is transmitted via the bore 24*a* first into the annular space 27 already described, and from there through an oblique bore 30 in the collar 19 of the right-hand lateral plate 39 into a right-hand bearing interspace 31 located opposite to the high-pressure working space 2. In an analogous manner the high-pressure fluid penetrates also out of the working space 2 via the axial bore 32 and the radial bore 33 in collar 18 of the left-hand lateral plate 38 into a pressure-tight annular space 34 in the left-hand external housing part 35, and via the radial bore 37 in collar 18 of the left-hand lateral plate 38 into the left-hand bearing interspace 40.

The sizes of the bearing interspaces 31 and 40 are so dimensioned that, together with the ridges 41, 42 and 43 and 44 which are left standing on the inside walls of collars 18 and 19, they afford an exact balance of the hydraulic forces. The reversibility of the machine is assured in that the external parts 35 and 42 of the housing and the lateral plates 38 and 39 are identical, but are mounted angularly displaced by 90° relative to one another. Thus, the machine works in the same way as described, when the high-pressure fluid is introduced through the threaded bore 1*a*. Bore 1*a* is in free communication with work space 2 on the low pressure side thereof via channel 24*a* in external housing part 35 and duct 30 in lateral plate 38. In this case the interspaces 31*a* and 40*a* work in an analogous manner as hydrostatic bearings and the motor rotates in the reverse direction.

Figure 5:
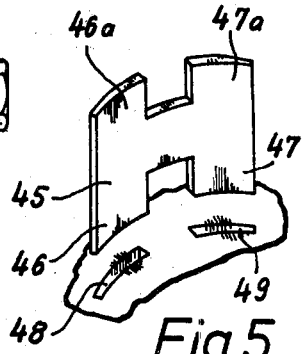
FIG. 5 shows in perspective exploded view the fastening of the gap-filling piece in a plate member.
Figure 4:
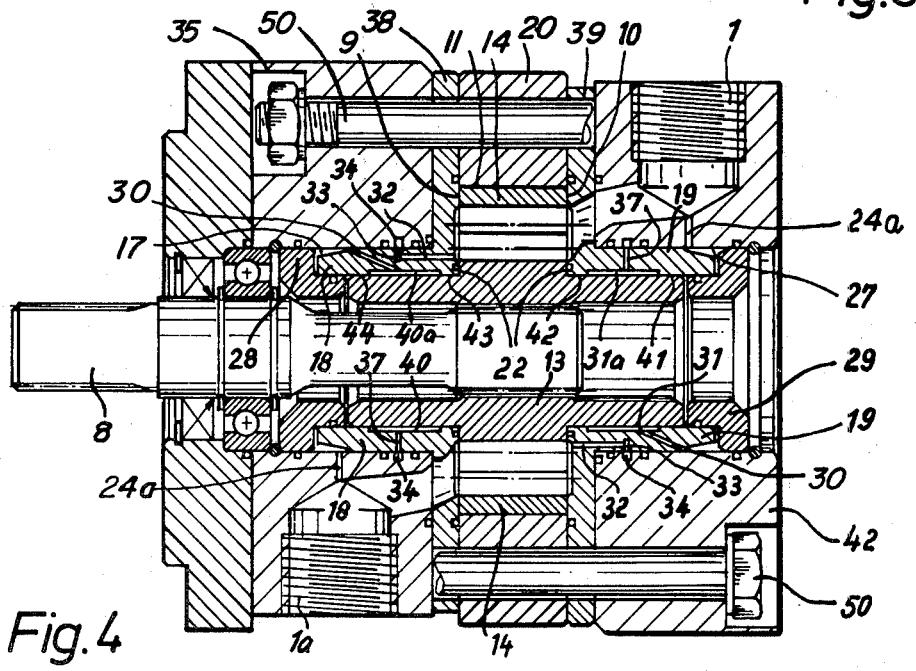
FIG. 4 shows, analogously to FIG. 3, in a longitudinal partially sectional view, a further embodiment of a machine, having a hydrostatically borne pinion shaft and a built-in drive or output shaft.

In FIG. 5 the gap-filling piece 45 is shown separately and it can be seen that the fastening extensions 46 and 46*a*, and 47 and 47*a* fit in corresponding openings 48 and 49 provided respectively in a lateral plate 38 or 39, with the least possible clearance to achieve an exact fixing of the gap-filling piece relative to the teeth of gears 13 and 14 and the bearing bores in the various housing parts.

The machine is now bolted down strongly for force and frictional contact with the aid of the through bolts 50 and optional, additional fastening bolts 51 extending through fitting bores 52 in the external housing parts 35 and 42, which parts are preferably exceptionally rigid and of high strength and can be made of steel or spheroidal-graphite cast iron, and which moreover can also be exactly identical for mirror-image mounting. Thus, extensions or projections in this bolting region are largely eliminated even with very high hydraulic pressures so that no measurable displacements of these parts relative to one another or to the central annular housing part can occur either axially or radially.

We claim:

1. A high-pressure rotary fluid-displacing machine suitable for use as a motor or pump comprising (a) a housing composed of at least two parts and having a first channel in said housing for conveying medium under high-pressure therethrough and a second channel in said housing for conveying medium under lower pressure therethrough, (b) an internally toothed annular gear;

(c) an externally toothed pinion arranged eccentrically within said annular gear and intermeshing therewith, an engagement-free crescent shaped gap being left between the addendum circles of said pinion and of said annular gear, respectively, on the side thereof opposite the contact point of the pitch circle of said pinion with the pitch circle of said annular gear;

(d) a shaft bearing said pinion and being adapted for transmitting torque;

(e) a gap-filling member in said gap having an inner and an outer curved surface, said inner surface being sealingly contacted by the addendum surfaces of the teeth of said pinion, and said outer surface being sealingly contacted by the addendum surfaces of the teeth of said annular gear, (f) at least a first lateral plate member held in place by at least one part of said housing and being adapted for closing off laterally a work space intermediate the teeth of said pinion and the teeth of said annular gear and disposed in axial direction on one side of said pinion and annular gear, the central region of said plate member being movable with a slight clearance relative to said pinion, said plate member having an external rim portion clamped in between two parts of said housing; and (g) a collar on said plate member and projecting from the face of the latter away from said pinion and annular gear and adapted for bearing said shaft therein; said housing having an internal chamber into which said collar protrudes, said internal chamber being in free communication with said first channel, whereby said plate member can be subjected to high-pressure exerted by said high-pressure medium.

2. The machine of claim 1, wherein the internal gearing of said annular gear and pinion is a trochoidal gearing.

3. The machine of claim 1, wherein said collar is integral with said plate member.

4. The machine of claim 3, wherein said plate member has an opening therein constituting a part of said first channel.

5. The machine of claim 1, further comprising (h) a second lateral plate member adapted for closing off the said work space in axial direction relative to said pinion and annular gear on the side thereof away from the first lateral plate member, and (i) a collar on said second plate member and projecting from the face of the latter away from said pinion and annular gear, said housing having another internal chamber, into which said collar on said second plate member protrudes, said other internal chamber being in free communication with said second channel, whereby the low-pressure of said low-pressure medium can be exerted on said second plate member.

6. The machine of claim 5, wherein at least one of said first and second plate members has a recess or opening in which said gap-filling member is lodged, with minimum play.

7. The machine of claim 6, wherein said gap-filling member bears at both end faces turned toward said first and second plate members projections adapted for being inserted in corresponding openings of said plate members.

8. The machine of claim 7, wherein said projections are provided in the outwardly disposed third of said end faces of said gap-filling member.

9. The machine of claim 5, wherein at least the central portions of said first and second plate members are slightly axially deformable, and which further comprises (j) an annular housing part surrounding said annular gear; the axial play of the latter gear being determined by the thickness of said annular housing part and the elastic deformability of said first and second plate members.

10. The machine of claim 9, wherein said housing comprises parts axially adjacent each of the outer faces, away from said pinion and annular gear, of said first and second plate members, and compensating fields are provided between each of said outer faces and the respective axially adjacent housing part, on the one hand, and the free end faces of said collars and said axially adjacent housing parts, on the other hand, said compensating fields being located within the range of the work spaces between the teeth of said pinion and annular gear and being subject to the respective working pressures prevailing in said work spaces.

11. The machine of claim 10 wherein, in order to provide said compensating fields, said internal chamber is in communication with said first channel via said crescent-shaped gap, and extends past said collar on said second plate member to the side of the latter facing away from said pinion and annular gear, thereby compensating pressure exerted by said medium from said crescent-shaped gap on the side of said second plate member facing toward said gear and pinion.

12. The machine of claim 10, wherein the axial play of the pinion is delimited by the thickness of the annular housing part surrounding the annular gear and by the elastic deformability of the central portions of the first and second plate members resulting from the sum of all forces, in axial direction, of the working spaces and compensating fields present in the machine.

13. The machine of claim 12 wherein, in order to provide said compensating fields, said internal chamber is in communication with said first channel via said crescent-shaped gap, and extends past said collar on said second plate member to the side of the latter facing away from said pinion and annular gear, thereby compensating pressure exerted by said medium from said crescent-shaped gap on the side of said second plate member facing toward said gear and pinion.

14. The machine of claim 9, wherein each of said collars has a frontal end face, and wherein said housing further comprises external housing parts disposed axially spaced from said frontal end faces of said collars.

15. The machine of claim 14, wherein said first and second plate members are equal to one another and the two axially disposed external housing parts are equal to one another, the first member of each of these pairs being disposed relative to the second member thereof with an angular displacement of 180°.

16. The machine of claim 14 wherein, in order to provide said compensating fields, said internal chamber is in communication with said first channel via said crescent-shaped gap, and extends past said collar on said second plate member to the side of the latter facing away from said pinion and annular gear, thereby compensating pressure exerted by said medium from said crescent-shaped gap on the side of said second plate member facing toward said gear and pinion.

17. The machine of claim 14, wherein said housing further comprises sealing members between said external housing parts and said frontal end faces of said collars, said sealing members and external housing parts delimiting said internal chambers into which said collars protrude.

18. The machine of claim 17, wherein said housing further comprises guard rings each of which secures a sealing member against axial displacement relative to the external housing part adjacent thereto.

19. The machine of claim 17, wherein each of said sealing members serves as a lid for said housing and is sealingly connectable with said housing.

20. The machine of claim 14, wherein said first and second plate members are fixed in determined positions clamping said annular housing part firmly in position therebetween, thereby determining exactly the spacing between the axes of the pinion and annular gear from one another, as well as the positioning of the pinion and annular gear relative to said gap-filling member, while said external housing parts are disposed with play axially of said frontal end faces of said collars on said first and second plate members.

21. The machine of claim 20, wherein said housing further comprises axially extending bolt-and-nut means for holding the parts of said housing together, and wherein the two external housing parts are centered with play solely about the respective collars adjacent to them, said bolt-and-nut means securing said external housing parts against rotation.

22. The machine of claim 21, wherein said collars have annular grooves and said housing comprises sealing members between said external housing parts and said collars, said sealing members sealingly engaging said annular grooves, connecting bores being provided in said collars for connecting said annular grooves therein with said work spaces and compensating field gaps.

23. The machine of claim 21, wherein the distribution of holes for screw-connecting the engine or pump to other apparatus is symmetrical relative to bores provided in said annular housing part for the insertion therein of said bolt-and-nut means destined for holding the parts of said housing together.

24. The machine of claim 21, wherein the annular housing part has a central bore in which said annular gear is lodged and wherein said housing further comprises a sliding layer covering the inner surface of said bore in said annular housing part.

25. The machine of claim 24, wherein said sliding layer is of tin-copper bronze alloy.

* * * * *